US006173149B1

(12) United States Patent
Kim

(10) Patent No.: US 6,173,149 B1
(45) Date of Patent: Jan. 9, 2001

(54) TRANSFER ROLLER OF AN ELECTROPHOTOGRAPHIC PRINTING APPARATUS FOR PROTECTING PHOTOCONDUCTIVE DRUM FROM STAINING AND METHOD OF MANUFACTURING TRANSFER ROLLER

(75) Inventor: Dong-Joon Kim, Suwon (KR)

(73) Assignee: SamSung Electronics Co., Ltd., Suwon (KR)

( * ) Notice: Under 35 U.S.C. 154(b), the term of this patent shall be extended for 0 days.

(21) Appl. No.: 08/829,673

(22) Filed: Mar. 31, 1997

(30) Foreign Application Priority Data

Mar. 29, 1996 (KR) ..... 96-9213

(51) Int. Cl.[7] ..... G03G 15/16; G03G 21/00
(52) U.S. Cl. ..... 399/313; 399/101
(58) Field of Search ..... 399/101, 313, 399/310

(56) References Cited

U.S. PATENT DOCUMENTS

| | | | |
|---|---|---|---|
| 4,379,630 | | 4/1983 | Suzuki . |
| 5,168,313 | | 12/1992 | Hosaka et al. . |
| 5,287,152 | | 2/1994 | Oka et al. . |
| 5,287,163 | | 2/1994 | Miyashiro et al. . |
| 5,406,360 | | 4/1995 | Asai . |
| 5,410,393 | | 4/1995 | Watanabe . |
| 5,459,560 | | 10/1995 | Bartholmae et al. . |
| 5,475,473 | * | 12/1995 | Masuda et al. ..... 399/168 |
| 5,483,330 | | 1/1996 | Ogiyama et al. . |
| 5,571,457 | | 11/1996 | Vreeland et al. . |
| 5,600,420 | * | 2/1997 | Saito et al. ..... 399/302 |

FOREIGN PATENT DOCUMENTS

| | | | |
|---|---|---|---|
| 4-215680 | * | 8/1992 | (JP) . |
| 7-199689 | * | 8/1995 | (JP) . |

* cited by examiner

*Primary Examiner*—Joan Pendegrass
(74) *Attorney, Agent, or Firm*—Robert E. Bushnell, Esq.

(57) ABSTRACT

There is disclosed, in an image forming apparatus using electrophotography having a photoconductive drum rotating in a clockwise direction and at a predetermined velocity, a charging roller for uniformly charging the photoconductive drum's outer surface, and a scanner unit for scanning the photoconductive drum's charged area to form a latent image thereon, a transfer roller for preventing the photoconductive drum from being stained with toner that is manufactured to have different properties at its center than at its edges so as to prevent a large quantity of positive charges from being applied to the edges of the photoconductive drum and the edges of the charging roller which are not in contact with the paper.

7 Claims, 4 Drawing Sheets

TRANSFER ROLLER OF AN ELECTROPHOTOGRAPHIC PRINTING APPARATUS FOR PROTECTING PHOTOCONDUCTIVE DRUM FROM STAINING AND METHOD OF MANUFACTURING TRANSFER ROLLER

CLAIM OF PRIORITY

This application makes reference to, incorporates the same herein, and claims all benefits accruing under 35 U.S.C. §119 from an application for *TRANSFER ROLLER OF AN ELECTROPHOTOGRAPHIC PRINTING APPARATUS FOR PROTECTING PHOTOCONDUCTIVE DRUM FROM STAINING AND METHOD OF MANUFACTURING TRANSFER ROLLER* earlier filed in the Korean Industrial Property Office on Mar. 29, 1996 and there duly assigned Serial No. 9213/1996.

BACKGROUND OF THE INVENTION

1. Field of the Invention

The present invention relates generally to an electrophotographic printing apparatus such as laser printers, photo copy machines, and regular paper facsimile machines. More particularly, it relates to a transfer roller of a printing apparatus which includes first rollers and second roller having different resistance properties in order to prevent a large amount of toner from adhering the ends of its charging roller and photoconductive drum.

2. Description of the Related Art

Varying the resistivity along the length of the transfer roller is not new in the art. U.S. Pat. No. 4,379,630 for a *Transfer Roller For Electrophotographic Apparatus* to Suzuki '630 discloses a transfer roller with a resistance value that varies in either a continuous or a stepwise manner toward the respective end faces at two end portions of the transfer roller. Suzuki uses as a varying resistance transfer roller to eliminate the problems called multiple copy fog phenomenon and multiple-copy edge line phenomenon. The multiple copy fog phenomenon and the multiple copy edge line phenomenon can be suppressed by using a transfer roller whose resistivity at the ends are different from the resistivity at the center. Unlike the arrangement in the present invention, Suzuki '630 uses a transfer roller and a photoconductive drum whose lengths are less than the width of a sheet of recording medium conveyed therebetween. As a result, Suzuki addresses and tries to correct different problems than that of the present invention. The present invention relies on the fact that the transfer roller and the photoconductive drum are longer than the width of recording medium.

SUMMARY OF THE INVENTION

It is an objective of the present invention to provide a transfer roller for an electrophotographic printing apparatus which prevents a photoconductive drum from being stained with toner in order to achieve the best possible print quality, and a method of manufacturing such a transfer roller where the length of the transfer roller is greater than the width of a sheet of recording medium.

It is another objective of the present invention to provide a transfer roller for an image forming apparatus which prevents a photoconductive drum from being stained with toner to enhance the photoconductive drum's durability, and a method of manufacturing such a transfer roller where the length of the transfer roller is greater than the width of a sheet of recording medium.

It is still another objective of the present invention to provide a transfer roller for an image forming apparatus which prevents a photoconductive drum from being stained with toner to thereby increase a charging roller's durability, and a method of manufacturing such a transfer roller where the length of the transfer roller is greater than the width of a sheet of recording medium.

It is a further objective of the present invention to provide a transfer roller for an electrophotographic printing apparatus which prevents the photoconductive drum from being stained with toner while uniformly charging an outer surface of the photoconductive drum, and a method of manufacturing such a transfer roller where the length of the transfer roller is greater than the width of a sheet of recording medium.

It is still further objective of the present invention to provide a transfer roller for an electrophotographic printing apparatus which prevents the photoconductive drum from being stained with toner and also prevents large amounts of toner from adhering to paper's tail end where the length of the transfer roller is greater than the width of a sheet of recording medium.

In order to realize the above objectives, the present invention provides a transfer roller for preventing the photoconductive drum from being stained with toner in an image forming apparatus using electrophotography having a photoconductive drum rotating in a clockwise direction and at a predetermined velocity, a charging roller for uniformly charging the photoconductive drum's outer surface, and a scanner unit for scanning the photoconductive drum's charged area to form a latent image thereon. The inventive transfer roller is manufactured to have different properties at its center than at its edges so as to prevent a large quantity of positive charges from being applied to the edges of the photoconductive drum and the edges of the charging roller which are not covered by the paper.

According to another aspect of the present invention, there is disclosed a method of manufacturing a transfer roller for electrophotographic printing apparatus for preventing a photoconductive drum from being stained with toner, including the steps of fabricating a center roller, above the center section, to have resistance adequate to transfer a toner image on the photoconductive drum's outer surface to paper; fabricating a pair of edge rollers, above the edges, to each have resistance higher than the center roller's so as to prevent a large quantity of positive charges from being applied to the edges of the photoconductive drum during toner image transfer; tightly attaching the center roller on the middle of a shaft about which the transfer roller rotates; and attaching the edge rollers on both ends of the shaft so that one side of each of the edge rollers comes in close contact with one side of the center roller and so that the entire length of the transfer roller is greater than the width of a sheet of recording medium.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
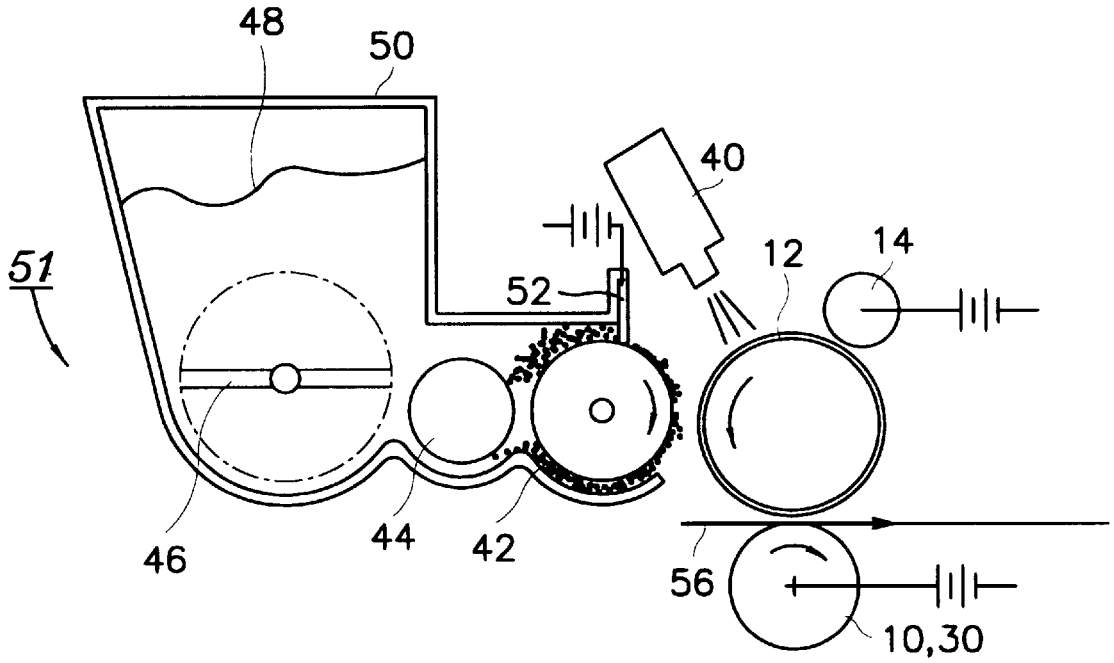
FIG. 1 (PRIOR ART)
FIG. 1 is a conventional image forming apparatus employing electrophotography.

A conventional electrophotographic printing process is now described with reference to FIG. 1. Toner 48 is provided to toner storage unit 50 located on the upper part of developing unit 51. The toner 48 is stirred by agitator 46 to create a static charge by friction. The toner 48 is transferred, by supply roller 44, to developing roller 42, and the toner layer 48 is formed on the outer surface of developing roller 42 with a predetermined thickness. The toner layer's thickness is regulated by doctor blade 52.

The outer surface of photoconductive drum 12 is uniformly charged with a negative polarity by charging roller 14. An electrical signal for image formation is applied to the negatively-charged area of the photoconductive drum 12 so that when the charged area is scanned with light produced by scanner unit 40 a latent image is formed on the negatively-charged area of photoconductive drum 12. The latent image is converted to a toner image through contact with developing roller 42.

Sheets of paper 56 loaded on a paper cassette are delivered to the printer's thermal print head one by one by a paper pickup roller. The toner image on the photoconductive drum 12 is transferred to the paper 56 by transfer rollers 10 and 30. The paper 56 then passes through a heating roller and a compression roller of a paper fixing unit where the toner image is fused on the paper by heat and pressure. The newly printed paper is discharged from the printing device to a top output tray (not shown). After toner image transfer, residual toner 48 on the outer surface of the photoconductive drum 12 is removed by a cleaner.

The following description concerns the operation of the charging roller 14, the photoconductive drum 12 and the transfer rollers 30 for such an electrophotographic printing apparatus.

Figure 2:
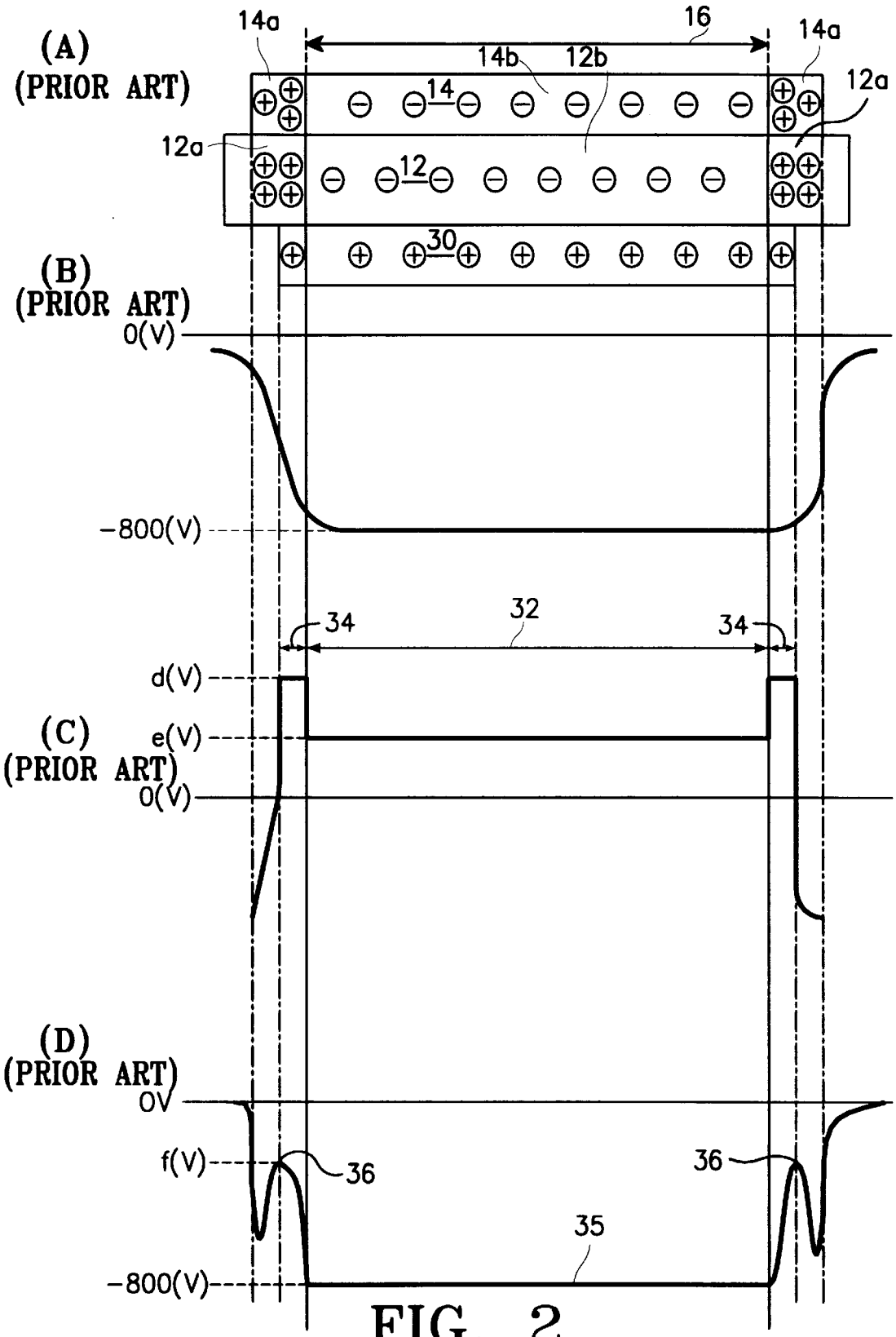
FIG. 2 (PRIOR ART)
FIG. 2A schematically depicts the contact relationship of a charging roller, a photoconductive drum and a transfer roller, and their surface conditions in accordance with a conventional art.
FIG. 2B graphically shows the condition of the photoconductive drum's outer surface when uniformly charged by the transfer roller.
FIG. 2C graphically shows the condition of the photoconductive drum's outer surface after toner image transfer in accordance with the conventional art.
FIG. 2D graphically shows the condition of the photoconductive drum's outer surface electrically charged by the charging roller after a toner image transfer in accordance with the conventional art.

FIG. 2A schematically depicts the contact relationship of the charging roller, the photoconductive drum and the transfer roller, and their surface conditions. Charging roller 14 rotates against the upper part of photoconductive drum 12 in a clockwise direction and at a predetermined velocity, where it electrically charges the outer surface of the photoconductive drum 12. Transfer roller 30 is mounted under the photoconductive drum 12 to transfer the toner image to the paper 56. Transfer roller 30 is designed to be larger than paper width 16, and charging roller 14 is designed to be larger than transfer roller 30.

The following description concerns the operation of the charging roller 14, the photoconductive drum 12 and the transfer roller 30. FIG. 2B graphically shows the condition of the photoconductive drum's 12 outer surface which has been uniformly charged by the transfer roller 30. FIG. 2C graphically shows the condition of the photoconductive drum's 12 outer surface after toner image transfer. FIG. 2D also graphically illustrates the condition of the photoconductive drum's outer surface after being electrically charged by the charging roller 14 following the toner image transfer. A voltage of −800V is applied to the outer surface of photoconductive drum 12 by charging roller 14, and the negatively-charged area of photoconductive drum 12 is scanned with light produced by scanner unit 40 on receipt of an electrical signal for image formation. As described above, a latent electrostatic image is created on the negatively-charged area of the photoconductive drum 12. The formed latent image is converted to a toner image by developing roller 42. Transfer roller 30 transfers the toner image on the outer surface of photoconductive drum 12 to the paper, with a voltage of +1.5 KV.

As transfer roller 30 is not uniformly charged to a positive polarity and photoconductive drum 12 is larger than the paper width 16, part of the drum (12*a*) which extend beyond paper 16's edges is also positively charged during toner image transfer. Accordingly, as shown in FIG. 2C, there is a large potential difference between the photoconductive drum's edges 12*a* and the middle portion of the drum 12. Charging roller 14's edges, 14*a*, contact the photoconductive drum 12's edges 12*a* and become positively charged.

When the printing operation resumes, charging roller 14 applies a voltage of −800V to the middle of photoconductive drum 12, middle portion 12*b*, so that middle portion 12*b* is negatively charged. Since the edges 12*a* were positively charged by transfer roller 30, and despite charging roller 14 applying charge of −800V to them, edges 12*a* become less negatively charged than middle portion 12*b*.

The negatively-charged area of the photoconductive drum 12 is scanned with light from scanner unit 40. A latent electrostatic image is formed on the scanned area of photoconductive drum 12, and is converted to a toner image by the developing roller 42. Since the toner 48 is negatively charged by agitator 46, the toner adheres to the latent image formed on the middle portion 12*b* of photoconductive drum. The transfer roller 30 then transfers the resulting toner image on photoconductive drum 12 to paper 56 with +1.5 KV.

Edges 12*a* of photoconductive drum 12, that are not in contact with the paper, are not satisfactorily charged by charging roller 14. Positive charges increase in edges 12*a*, causing large amounts of toner 48 to adhere to the edges 12*a*. The toner 48, at the edges 12*a* of the photoconductive drum, stain the edges 14*a* of the charging roller 14. When the toner image is transferred to paper 56, the tail end of the paper 56 is smudged with a large amount of toner 48. This causes photoconductive drum 12 to be frequently replaced with new one.

Figure 3:
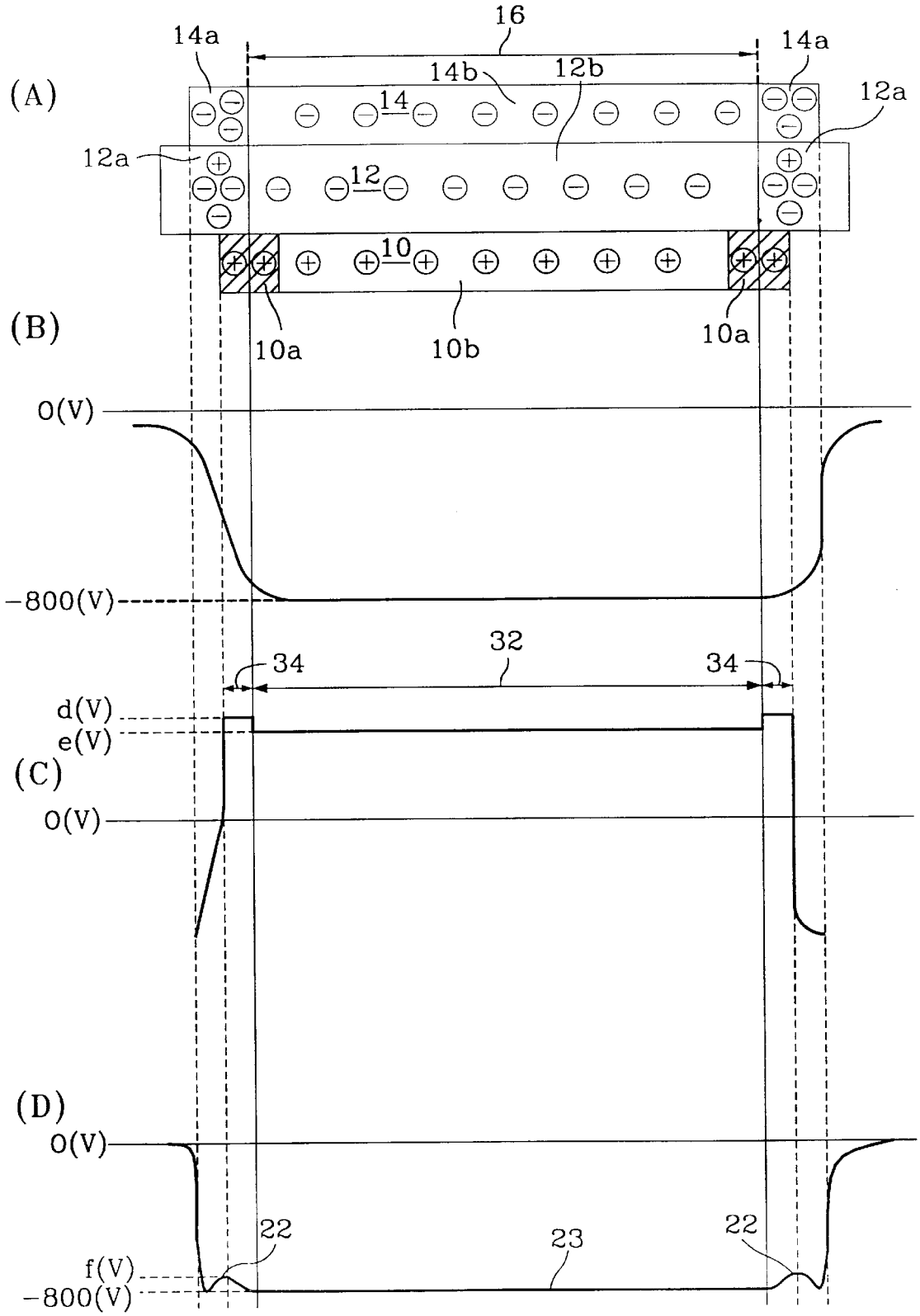
FIG. 3A schematically depicts the contact relationship of a charging roller, a photoconductive drum and a transfer roller, and their surface conditions in accordance with the present invention.
FIG. 3B graphically show the condition of the photoconductive drum's outer surface when uniformly charged by the transfer roller.
FIG. 3C graphically shows the condition of the photoconductive drum's outer surface after toner image transfer in accordance with the present invention.
FIG. 3D also graphically depicts the condition of the photoconductive drum's outer surface electrically charged by the charging roller after the toner image transfer in accordance with the present invention.
Figure 4:
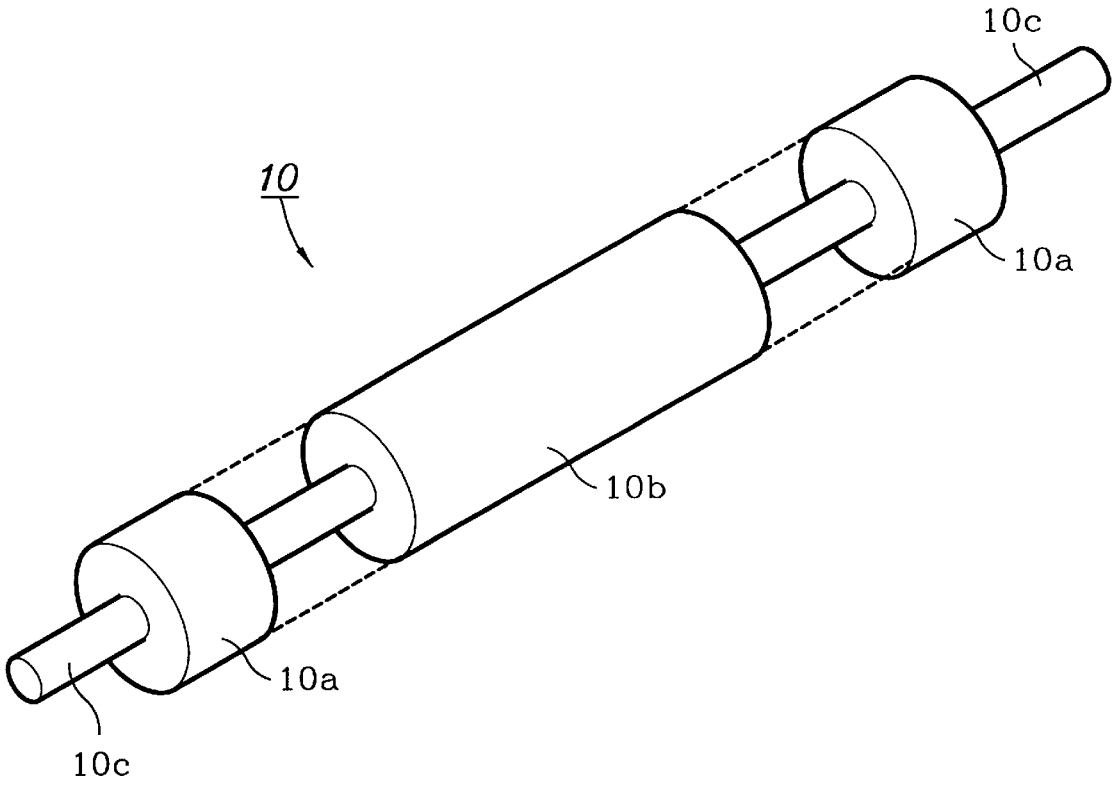
FIG. 4 is an exploded-perspective view of the transfer roller in accordance with the present invention.

As shown in FIGS. 3A and 4, charging roller 14 rotates in a clockwise direction against upper part of photoconductive drum 12 and at a predetermined velocity, and charging roller 14 electrically charges the outer surface of the photoconductive drum 12. Transfer roller 10 is installed under photoconductive drum 12 to transfer the toner image to the paper 56.

Transfer roller 10 is of improved structure prevents the edges 12*a* of photoconductive drum 12 and edges 14*a* of charging roller 14, which extend beyond the paper, from being positively charged, thus preventing negatively-charged toner 48 from adhering to them. That is, the transfer roller 10 includes a center section 10*b*, and edges 10*a* on shaft 10*c* which extend beyond the edges of paper width 16 by a predetermined length. The edges 10*a* and the center section 10*b* are made from materials with different resistance properties, or they may be made from the same hydrine material with different resistance properties. Transfer roller 10 is designed to be larger than the paper width 16. Likewise, charging roller 14 is larger than transfer roller 10.

The effect and advantages of the present invention are described as follows. The center section 10*b* of transfer roller 10, is designed to have resistance adequate to transfer the toner image on the outer surface of photoconductive drum 12 to paper 56. In order to prevent the edges 12*a*, from being positively charged during toner image transfer, the edge sections 10*a* of transfer roller 10 are fabricated to have resistance higher than the center section 10*b*. Center section 10*b* is tightly fitted to a middle part of shaft 10*c* about which the transfer roller 10 rotates, and the edge sections 10*a* are tightly fitted to both ends of shaft 10*c* so that one side of each edge section 10*a* cortacts one side of the center section 10*b*.

FIG. 3B graphically shows the voltage potential versus length of the photoconductive drum's outer surface which has been uniformly charged by transfer roller 10, and FIG. 3C graphically shows the voltage potential versus length of the outer surface of photoconductive drum 12 after toner image transfer. FIG. 3D also graphically illustrates the voltage potential versus length of the outer surface of photoconductive drum 12 which is electrically charged by charging roller 14 after the toner image transfer.

Referring to FIGS. 3B, 3C and 3D, the operation of the charging roller 14, the photoconductive drum 12 and the transfer roller 10 is now described. A voltage of −800V is applied to the outer surface of photoconductive drum 12 by charging roller 14. The charged area of the photoconductive drum 12 is exposed to light on receipt of an electrical signal for image formation. A latent electrostatic image is formed on the initially charged area of drum 12 that is scanned with light.

The latent image formed on the outer surface of the photoconductive drum 12 is converted into a toner image by developing roller 42. The transfer roller 10 transfers the toner image on the photoconductive drum 12 to the paper 56. Transfer roller 10 has a voltage of +1.5 KV. The transfer roller 10 has a composite construction, with center portion 10*b* and edge portions 10*a*. Center portion 10*b* has a different resistance property than edge portions 10*a*. Nevertheless, the overall outer surface of the transfer roller 10 is positively charged by a voltage of +1.5 KV.

Specifically, the center section 10*b* is more positively charged than the edges 10*a*, so the transfer roller 10 becomes uniformly charged to a predetermined polarity adequate for toner image transfer. Even if photoconductive drum 12 is designed to be larger than paper width 16, positive charges from the edge 10*a* move to the edges of the photoconductive drum 12*a* not covered by paper 56 so that there is a small potential difference between the middle portion of photoconductive drum 12*b* and the edge portions 12*a*. The positive charges do not influence charging roller 14 that comes in contact with the area 12*a*.

As the printing operation goes on, a voltage of −800V is applied to the middle portion of photoconductive drum 12*b* and to the edge portions of photoconductive drum 12*a* by the charging roller 14 so that the photoconductive drum 12 is uniformly charged, as shown in FIG. 3D. As described above, the charged area of the photoconductive drum 12 is scanned by the scanner unit 40 on receipt of an electrical signal for image formation so that a latent electrostatic image is formed thereon. The developing roller 42 converts the latent image formed on the outer surface of photoconductive drum 12 to a toner image. Subsequently, the toner image on photoconductive drum 12 is transferred to paper 56 by transfer roller 10 and the toner image is fused to the paper surface by heat.

According to the present invention, the transfer roller has a composite construction where the edges and center have different resistance properties so as to prevent positive charges from the edges of the transfer roller from moving to the ends of the photoconductive drum 12*a*, causing the photoconductive drum to not retain large amounts of toner which will adhere to its surface. This may enhance the durability of the photoconductive drum and the charging roller. Since the charging roller and the photoconductive drum are not stained with toner, users can obtain printed images of high resolution. In addition, the present invention prevents the toner from staining the tail of paper thereby enhancing the reliability of the printing system.

Therefore, it should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. In an electrophotographic image forming apparatus, comprising:

a photoconductive drum rotating in a clockwise direction and at a predetermined velocity;

a charging roller for uniformly charging an outer surface of the photoconductive drum;

a scanner unit for scanning a charged area of the photoconductive drum to form a latent image thereon; and a transfer roller having a center portion and two edge portions, said transfer roller for preventing the photoconductive drum from being stained with toner, said transfer roller being longer than a width of a recording medium, said transfer roller being manufactured to have different properties at said center portion than at said two edge portions so as to prevent a large quantity of positive charges from being applied to edges of the photoconductive drum and to edges of the charging roller which are not covered by said recording medium.

2. The electrophotographic image forming apparatus according to claim 1, wherein said center portion of said transfer roller is mounted at the middle of the transfer roller, and said edge portions are respectively mounted on both ends of the transfer roller.

3. The electrophotographic image forming apparatus according to claim 1, wherein said two edge portions of said transfer roller extend beyond both sides of the recording medium by a predetermined length.

4. The electrophotographic image forming apparatus according to claim 3, wherein said two edge portions and said center portion of said transfer roller are made from different materials with different resistance properties.

5. The electrophotographic image forming apparatus according to claim 3, wherein said two edge portions and said center portion of said transfer roller are made from the same material.

6. The electrophotographic image forming apparatus according to claim 3, wherein said two edge portions and said center portion of said transfer roller are made from the same material and designed to have different resistance properties.

7. The electrophotographic image forming apparatus according to claim 5, wherein said two edge portions and said center portion of said transfer roller are made from a hydrine material.

* * * * *